US006678895B1

(12) United States Patent
Grilliot et al.

(10) Patent No.: US 6,678,895 B1
(45) Date of Patent: Jan. 20, 2004

(54) PROTECTIVE GARMENT, WHICH IS WORN WITH SHOULDER PAD HAVING INFLATABLE BLADDER, FOR FIREFIGHTER OR FOR EMERGENCY WORKER

(75) Inventors: William L. Grilliot, Dayton, OH (US); Mary I. Grilliot, Dayton, OH (US); Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/443,640

(22) Filed: May 22, 2003

(51) Int. Cl.[7] ..... A41D 27/26
(52) U.S. Cl. ..... 2/81; 2/268
(58) Field of Search ..... 2/69, 79, 93, 94, 2/81, 108, 227, 229, 44, 102, 267, 459, 460, 461, 268; 182/3–6; 428/166, 920, 921

(56) References Cited

U.S. PATENT DOCUMENTS 900,610 A * 10/1908 Stow ..... 224/264
3,257,666 A * 6/1966 Hoffman ..... 2/459
3,883,053 A * 5/1975 Pritchard et al. ..... 224/264
4,575,874 A * 3/1986 Johnson ..... 2/460
4,879,768 A * 11/1989 McClees et al. ..... 224/264
RE34,094 E 10/1992 Grilliot et al.
5,274,849 A 1/1994 Grilliot et al.
5,572,991 A 11/1996 Grilliot et al.
6,305,024 B1 * 10/2001 Schweer ..... 2/94
6,481,015 B1 11/2002 Lanier
6,487,725 B1 * 12/2002 Jordan ..... 2/94

* cited by examiner

*Primary Examiner*—Tejash Patel
(74) *Attorney, Agent, or Firm*—Wood, Phillips, Katz, Clark & Mortimer

(57) ABSTRACT

A protective garment, such as a protective coat or protective coveralls, for a firefighter or for an emergency worker is provided with a shoulder pad, which is worn between the protective coat and a shoulder of a wearer. The shoulder pad is attached detachably, as by a hook-and-loop fastener, to a shoulder strap of suspenders worn by the wearer or to the protective garment. The shoulder pad contains a bladder, which is adapted to be inflated with a suitable fluid, preferably air, so to increase an air space between the protective coat and the shoulder of the wearer. The air space provides thermal insulation between the protective garment and the shoulder of the wearer.

8 Claims, 3 Drawing Sheets

PROTECTIVE GARMENT, WHICH IS WORN WITH SHOULDER PAD HAVING INFLATABLE BLADDER, FOR FIREFIGHTER OR FOR EMERGENCY WORKER

TECHNICAL FIELD OF THE INVENTION

This invention pertains to an improvement in a protective garment, such as a protective coat or protective coveralls, for a firefighter or for an emergency worker. This invention contemplates that the protective garment is worn with a shoulder pad containing an inflatable bladder.

BACKGROUND OF THE INVENTION

Commonly, a firefighter or an emergency worker wears protective garments, such as a protective coat or protective coveralls having plural layers, which include an outer layer providing abrasion resistance, an intermediate layer providing a moisture barrier, and an inner layer providing thermal insulation, and such as protective trousers having similar layers and being worn with suspenders, which have shoulder straps.

As exemplified in U.S. Pat. Nos. 5,572,991, 5,274,849, and U.S. Re. Pat. No. 34,094, it is known that an air space in such a garment provides thermal insulation. U.S. Pat. No. 5,274,849 discloses a spacer element, which is interposed between two layers of such a garment so as to maintain an air space therebetween.

SUMMARY OF THE INVENTION

This invention provides, in a protective garment for a firefighter or for an emergency worker, an improvement wherein the protective garment is provided with a shoulder pad, which is to be worn between the protective coat and a shoulder of a wearer. The shoulder pad is attached detachably, as by a hook-and-loop fastener, to a shoulder strap of suspenders worn by the wearer or to the protective coat. The shoulder pad contains a bladder, which is adapted to be inflated with a suitable fluid, such as a gas, liquid, or gel, so to increase an air space between the protective coat and the shoulder of the wearer. The air space provides thermal insulation between the protective coat and the shoulder of the wearer.

BRIEF DESCRIPTION OF THE DRAWINGS

In FIG. 1, the shoulder pad and the shoulder strap are shown in broken lines, as concealed by the protective coat. In FIG. 2, the protective coat is broken away and is shown in two positions, which correspond respectively to an inflatable bladder in the shoulder pad being inflated and being deflated.

FIG. 3 is a plan view. FIG. 4 is a side view. FIG. 5, which shows the shoulder strap, is a fragmentary, sectional view taken along line 5—5 in FIG. 2, in a direction indicated by arrows.

In FIG. 6, the shoulder pad is sewn to the protective coat. In FIG. 7, a hook-and-loop fastener is used to attach the shoulder pad detachably within and to the protective coat. In FIG. 8, two hook-and-loop fasteners are used to attach the shoulder pad detachably within and to the protective coat.

DETAILED DESCRIPTION OF THE ILLUSTRATED EMBODIMENTS

Figure 1:
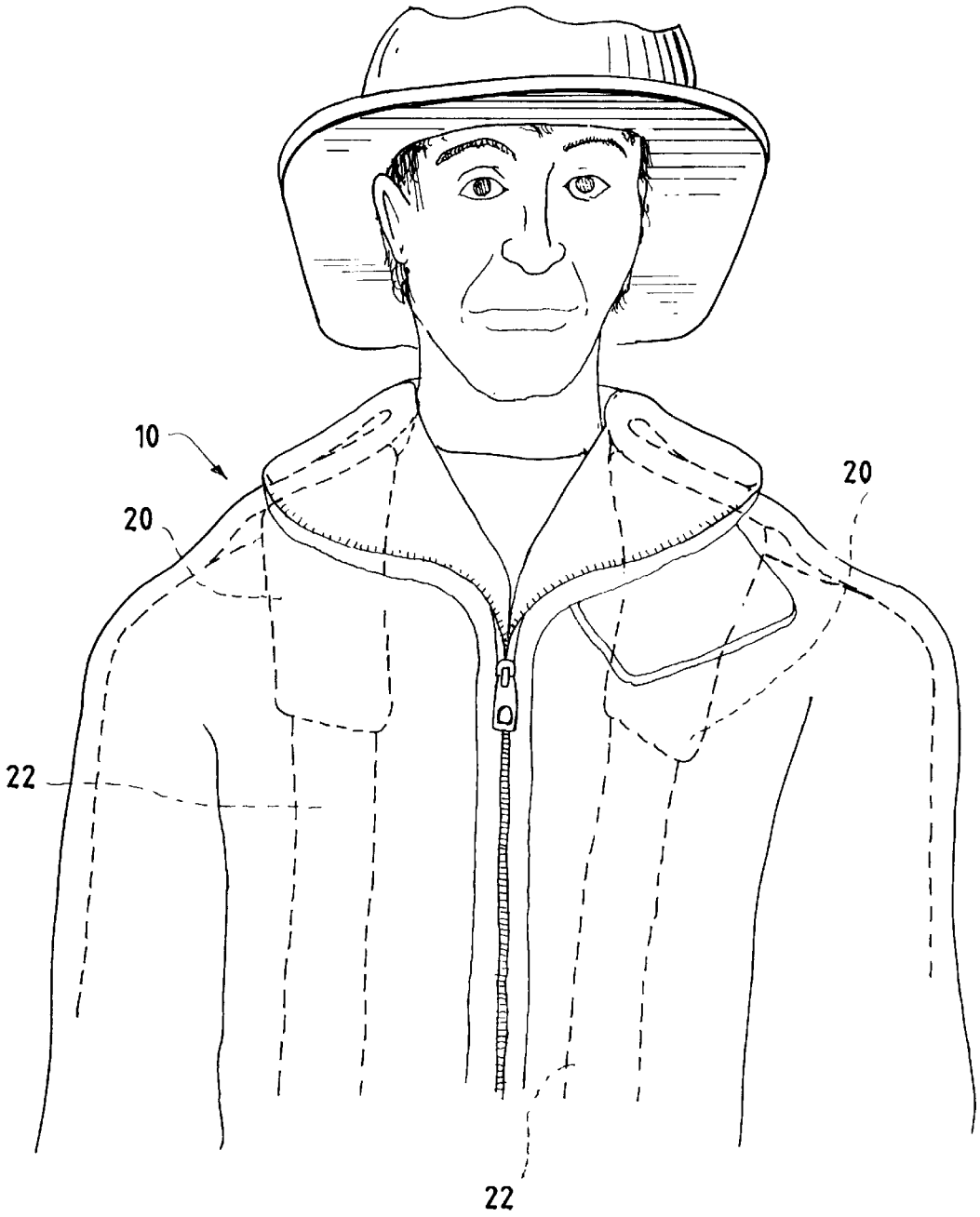
FIGS. 1 and 2 are fragmentary, perspective views of a protective coat, as provided with two shoulder pads, each of which is worn between the protective coat and a shoulder of a wearer and each of which is attached detachably to a shoulder strap of suspenders worn by the wearer, in a preferred embodiment of this invention.
Figure 2:
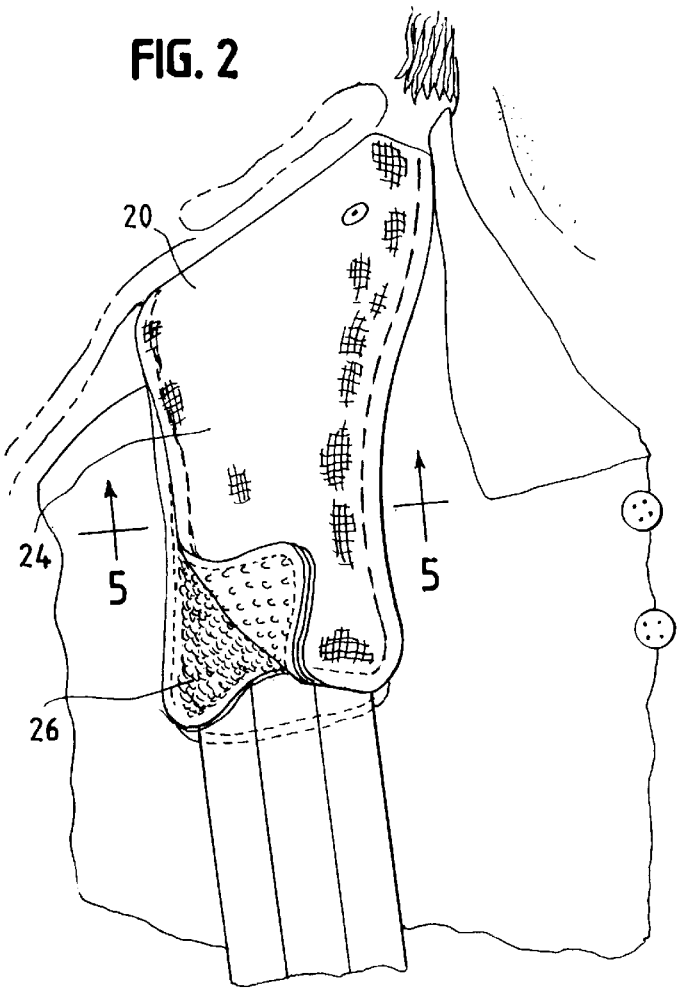

As illustrated in FIGS. 1 and 2, a protective coat 10 worn by a firefighter is provided with two shoulder pads 20, each of which is worn between the protective coat 10 and a shoulder of the firefighter. Each shoulder pad 20 is attached detachably, in a manner described below, to a shoulder strap 22 of suspenders worn by the firefighter.

As illustrated in FIGS. 2 through 5, each shoulder pad 20 has a pouch 24 and a flap 26, which extends from the pouch 24, which is wrapped around the shoulder strap 20, and which is attached detachably to the pouch 24, via a hook-and-loop fastener 30. The hook-and-loop fastener 30 comprises a hook-faced strip 32, which is sewn to the pouch 22, and a loop-faced strip 34, which is sewn to the flap 24.

Figure 3:
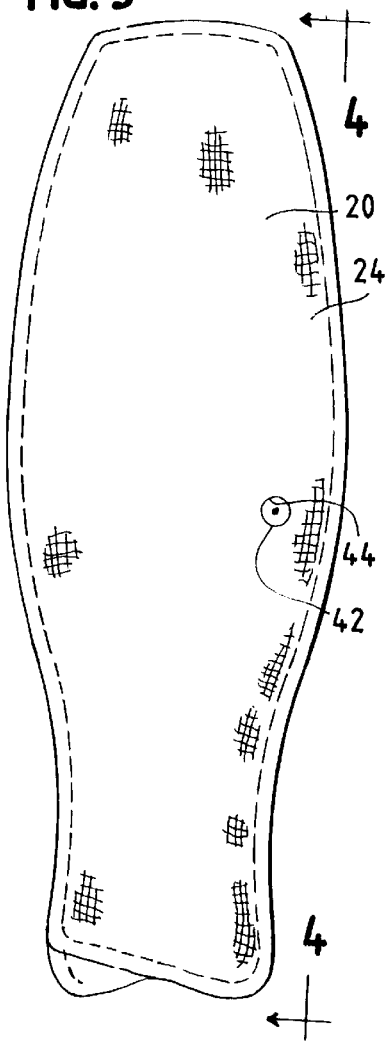
FIGS. 3, 4, and 5 show the shoulder pad, apart from the protective coat.
Figure 4:
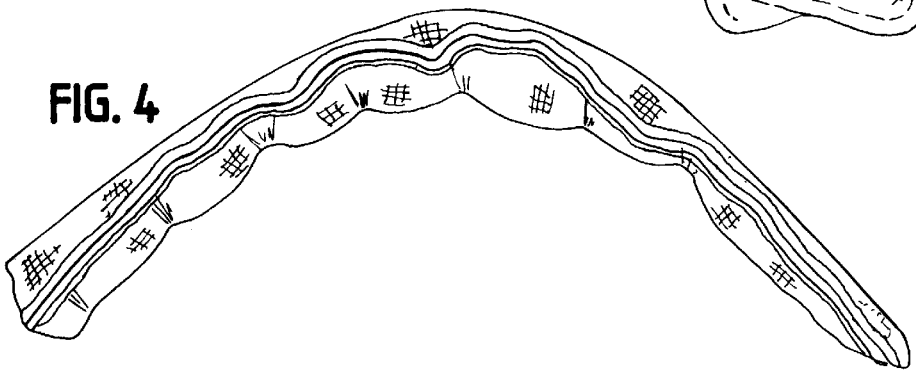
Figure 5:
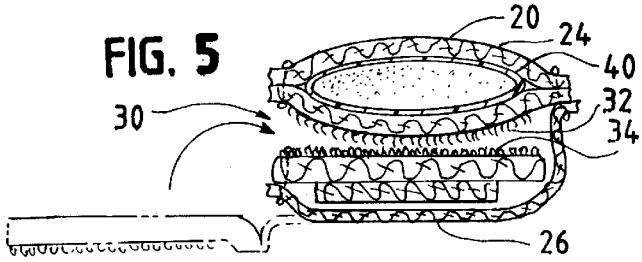

As illustrated in FIG. 5, the pouch 24 contains a bladder 40, which is made of a synthetic rubber and which is inflatable with a suitable gas, such as air, or with a suitable liquid, such as water, or with a suitable gel, air being a preferred fluid to inflate the bladder 40. As illustrated in FIG. 3, the bladder 40 has a valve 42, which extends outwardly though a hole 44 in the pouch 24 and through which the bladder 40 is inflatable. Any suitable means for providing a pressurized fluid, such as an air pump or an air-pressurized canister, may be used for inflating the bladder 40.

Each shoulder pad 20 is similar to shoulder pads available commercially heretofore from Dielectrics Industries of Chicopee, Mass., as shoulder-cushioning pads for postal workers who are required to carry heavy bags, via shoulder straps. Moreover, the inflating means may be similar to any of the inflating means available commercially heretofore from Dielectrics Industries, supra.

Figure 6:
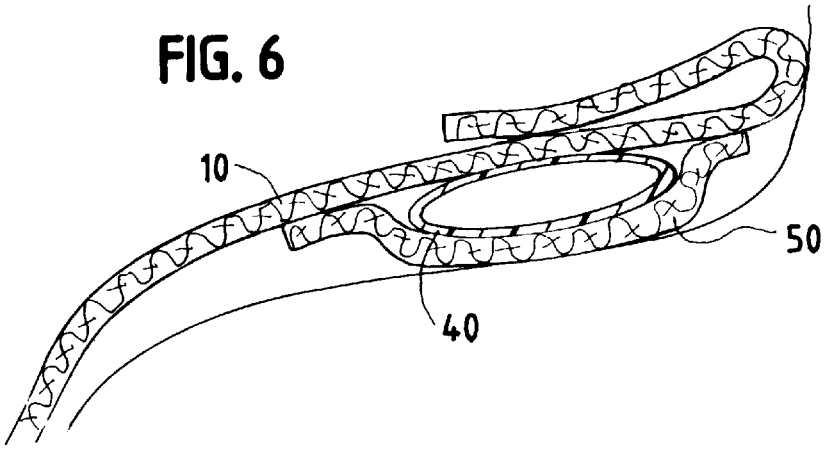
FIGS. 6, 7, and 8 are fragmentary, sectional views showing alternative embodiments of a shoulder pad containing an inflatable bladder and attached detachably within and to a protective coat.
Figure 7:
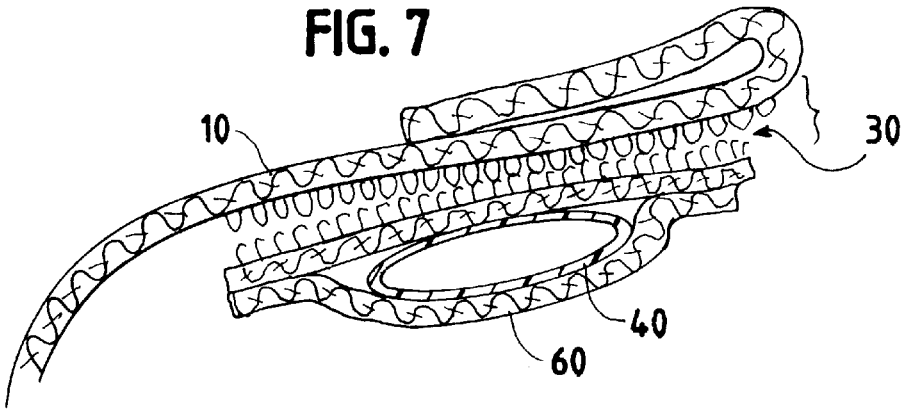
Figure 8:
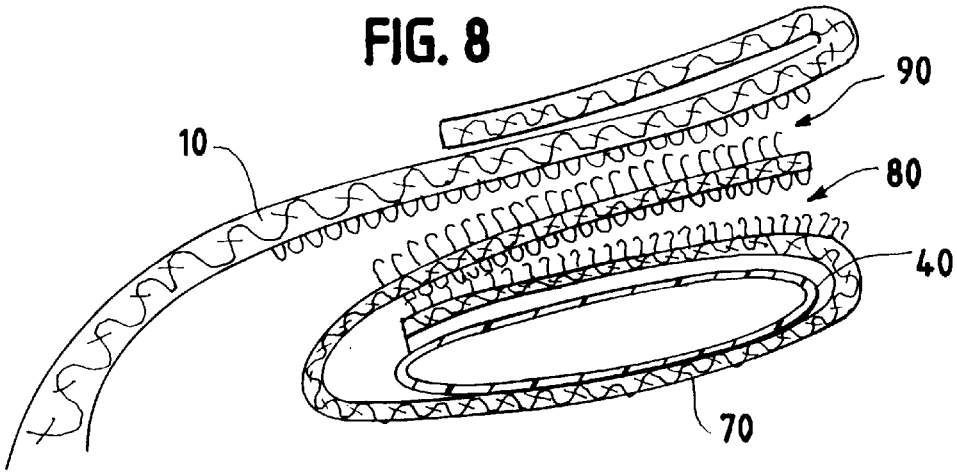

In each of the alternative embodiments illustrated in FIGS. 6, 7, and 8, a shoulder pad is attached within and to the protective coat 10. In the embodiment illustrated in FIG. 6, the shoulder pad comprises a fabric panel 50, which is sewn to the protective coat 10 so as to confine an inflatable bladder 40 between the fabric panel 52 and the protective coat 10. In the embodiment illustrated in FIG. 7, the shoulder pad comprises a pouch 60, which confines an inflatable bladder 40 and which is attached detachably to the protective coat 10, via a hook-and-loop fastener 30. In the embodiment illustrated in FIG. 8, the shoulder pad comprises a fabric strip 70, which is wrapped around an inflatable bladder 40, which is attached detachably to itself, via a hook-and-loop fastener 80 similar to the hook-and-loop fastener 30, and which is attached detachably to the protective coat, via a hook-and-loop fastener 90 similar to the hook-and-loop fastener 30.

In each embodiment illustrated and described herein, whenever the firefighter perceives a need for further insulation, the firefighter can operate the inflating means so as to inflate the inflatable bladders of the shoulder pads, whereby to increase air spaces providing thermal insulation between the protective coat and the shoulders of the firefighter.

Although the protective garment is a protective coat in each embodiment illustrated and described herein, this invention may be embodied in another protective garment, such as protective coveralls.

What is claimed is:

1. In a protective garment for a firefighter or for an emergency worker, an improvement wherein a shoulder pad is provided, which is adapted to be worn between the protective garment and a shoulder of a wearer, and wherein the shoulder pad comprises means for enabling the wearer to increase an air space between the protective garment and the shoulder of the wearer, whenever the wearer perceives a need for further insulation, the air space providing thermal insulation between the protective garment and the shoulder of the wearer.

2. The improvement of claim 1 wherein the shoulder pad is attached to a shoulder strap of suspenders to be worn by the wearer.

3. The improvement of claim 2 wherein the shoulder pad is attached detachably to the shoulder strap.

4. The improvement of claim 1 wherein the shoulder strap is attached to the protective garment.

5. The improvement of claim 4 wherein the shoulder strap is attached detachably to the protective garment.

6. The improvement of any one of claims 1 through 5 wherein said means comprises a bladder, which is adapted to be inflated so as to increase the air space.

7. The improvement of claim 6 wherein the bladder is adapted to be inflated with a suitable fluid, which is a gas, liquid, or gel.

8. The improvement of claim 6 wherein the bladder is adapted to be inflated with a suitable fluid, which is air.

* * * * *